US006309267B1

(12) United States Patent
Okabe et al.

(10) Patent No.: US 6,309,267 B1
(45) Date of Patent: Oct. 30, 2001

(54) PROTECTIVE COVERING SYSTEM FOR OUTBOARD MOTOR

(75) Inventors: Yoshihiko Okabe; Kenichi Fujino; Masafumi Sogawa, all of Shizuoka (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/563,163

(22) Filed: May 1, 2000

(30) Foreign Application Priority Data

May 6, 1999 (JP) ..... 11-126404
May 10, 1999 (JP) ..... 11-127853

(51) Int. Cl.[7] ..... B63H 20/32
(52) U.S. Cl. ..... 440/77; 123/195 P; 440/84
(58) Field of Search ..... 440/76, 77, 84; 123/195 R, 195 P, 195 HC, 336

(56) References Cited

U.S. PATENT DOCUMENTS 5,617,821 * 4/1997 Tsunoda et al. ..... 123/195 P
5,943,996 * 8/1999 Sogawa et al. ..... 123/195 P
5,957,108 * 9/1999 Kato ..... 123/195 A
5,960,770 * 10/1999 Taue et al. ..... 123/197.3

* cited by examiner

*Primary Examiner*—Jesus D. Sotelo
(74) *Attorney, Agent, or Firm*—Knobbe, Martens, Olson & Bear, LLP

(57) ABSTRACT

An outboard motor includes various protective covers for engine components. The outboard motor can include a protective cover for electrical wires which extend around an outer periphery of the engine, so as to protect the wires from being inadvertently dislodged when installing or removing an upper cowling. The outboard motor may also include a protective sleeve extending vertically, and through which wires are arranged to prevent the wires from contacting water which may collect in a lower portion of a powerhead of the outboard motor. Additionally, the outboard motor can also include a protective casing for electrical components including relays, fuses, and associated connectors. The protective casing includes a main storage portion and a substorage portion. The main storage portion includes a lid and is configured to have a watertight seal around only a portion of its outer periphery. The substorage portion includes a lid separate from the lid of the main portion, and includes a substantially watertight seal around substantially its entire periphery. The main storage portion is used for protecting electrical components that are substantially waterproof. The substorage portion, on the other hand, is used for storing nonwaterproof electrical components, such as certain fuses and relays.

39 Claims, 12 Drawing Sheets

PROTECTIVE COVERING SYSTEM FOR OUTBOARD MOTOR

PRIORITY INFORMATION

This application is based on and claims priority to Japanese Patent Application No. 11-126404, filed May 6, 1999, and Japanese Patent Application No. 11-127853, filed May 10, 1999.

BACKGROUND OF THE INVENTION

1. Field of the Invention

The present invention is directed to an outboard motor for a watercraft, and more particularly to a protective covering system for components of an engine in a marine outboard motor.

2. Description of Related Art

As is well known, outboard motors generally include a powerhead that consists of a powering internal combustion engine and a surrounding protective cowling. The cowling is provided around the engine so as to provide a neater appearance, to protect the engine from foreign materials, as well as for aerodynamic considerations. Of course, it is necessary that the protective cowling have an inlet opening arrangement so that air can enter the protective cowling in adequate quantities for combustion purposes. This gives rise to a number of problems.

First, it is important that the cowling inlet opening be positioned and configured to allow air flow to the engine that is adequate for the desired output from the engine. However, during operation in a body of water, water is frequently sprayed upwardly into the proximity of the inlet opening. Thus, it is desirable to provide insurance against the ingestion of water through the inlet opening into the interior of the protective cowling, to prevent damage to the engine.

Although the goal of preventing water from entering the protective cowling of an outboard motor is important, achieving this goal is complicated. Additionally, it is desirable to provide the powerhead with a slim profile and to avoid making the powerhead excessively tall. Accordingly, the upper cowling desirably is sized and shaped to fit tightly around the outer contours of the internal combustion engine provided in the outboard motor and to create a symmetric flow of air around the engine. Thus, the space available for air induction and water separation is quite restricted.

SUMMARY OF THE INVENTION

A need therefore exists for a protective cover for an internal combustion engine provided within an outboard motor that has a compact arrangement. It is desirable that the cover is less expensive and easier to manufacture and service than known covers.

One aspect of the present invention includes the realization that the fuel injectors of known fuel-injected outboard motors have been inadequately protected from water entering the protective cowling. In particular, it has been found that even small amounts of salt water contacting fuel injectors can heavily damage the fuel injector over time.

Accordingly, an outboard motor constructed in accordance with an aspect of the present invention includes a fuel injected internal combustion engine and a cowling covering the engine. The engine includes an engine body and an output shaft, and is mounted such that the output shaft rotates about a vertically extending axis. The engine includes at least a first fuel injector extending from the engine body transverse to the vertical axis. A first cover that is independent of the cowling, extends over the first fuel injector. As such, the cover provides enhanced protection from water damage. Preferably, the cover also extends along at least one side of the fuel injector. As such, the cover is particularly useful for V-type engines.

For example, the outboard motor may include an engine having two cylinder banks, forming a valley therebetween, each bank having a plurality of cylinders and corresponding fuel injectors. Each of the fuel injectors has an inner side facing the valley and an outer side facing away from the valley. Preferably, the cover extends along the outer sides of the fuel injectors. Thus, while the inner side of the fuel injectors are partially shielded by the valley and other engine components provided therein, e.g., the exhaust system, the outer side is protected from splashing water by the cover. Additionally, by constructing the cover so that it is independent of the cowling, the cover may remain in place when the protective cowling is removed. This is particularly useful because, when the protective cowling of an outboard motor is removed, there may be water droplets adhered to the inner and/or outer surface of the protective cowling. Thus, when the protective cowling is raised over the engine during a removal process, the water droplets may drain off the protective cowling onto the engine. Thus, by constructing the cover so as to extend over the fuel injectors, the cover prevents the fuel injectors from incurring further water damage.

Another aspect of the present invention includes the realization that electrical wires that extend substantially horizontally around an outer periphery of the engine body may be inadvertently dislodged when a protective cowling is being reinstalled on an outboard motor. For example, protective cowlings typically include hooks or clips on a lower peripheral edge which are configured to engage a lower cowling of the outboard motor. Thus, when the upper cowling is being lowered over the internal combustion engine, the hooks or clips may engage a portion of any electrical wire that extends substantially horizontally and around an outer periphery of the engine and thereby dislodge the wire, thus making it more difficult to install the protective cowling onto the outboard motor.

Accordingly, an outboard motor constructed in accordance with a further aspect of the present invention includes an internal combustion engine and a cowling covering the engine. The engine includes an engine body and an output shaft and is mounted such that the output shaft rotates about a vertically extending axis. The engine also includes a plurality of electrical components and at least a first electrical wire extending between two of the electrical components. At least a portion of the first electrical wire extends transversely to the vertical axis and along an outer periphery of the engine body. The outboard motor also includes a cover covering the transversely extending portion of the electrical wire. Thus, the transversely extending portion of the electrical wire is prevented from becoming engaged with a hook or clip formed on the protective cowling.

For example, an ignition wire of an internal combustion engine provided in an outboard motor extends between an ignition coil and a spark plug of the engine. Desirably, ignition wires are arranged around an outer periphery of the engine body so as to protect the ignition wires from the heat generated by the engine and to prevent potential grounding, due to the high voltages and currents which pass through ignition wires. Thus, ignition wires can be particularly susceptible to being caught in a hook or clip provided on the lower edge of a protective cowling when the cowling is being lowered over the engine. If the ignition wire is caught by the upper cowling as it is lowered over the engine, the ignition wire may be pulled out of engagement with the spark plug, for example, thereby preventing the proper operation of the engine. Thus, a user may be required to repeatedly remove and install the cowling to the outboard motor.

Another aspect of the invention includes a realization that where electrical wires extend in proximity to a fuel supply line, electrical current may leak through the insulation of the wire as well as the walls of the fuel line and undesirably heat the fuel or cause malfunction of the fuel injectors.

Accordingly, an outboard motor constructed in accordance with yet another aspect of the present invention includes an internal combustion engine and a cowling covering the engine. The engine includes an engine body and an output shaft, the engine body being mounted such that the output shaft rotates about a vertically extending axis. The engine includes at least a first charge former configured to deliver a fuel charge to the engine body. A fuel supply line supplies fuel to the charge former. The outboard motor also includes a plurality of electrical components and at least a first electrical wire connecting the electrical components and extending transverse to the fuel supply line. The outboard motor also includes a cover covering at least a portion of the fuel supply line and the first electrical wire such that the electrical wire extends between the cover and the fuel supply line. The cover also includes at least a first engagement device provided on the cover which is configured to engage the first electrical wire and maintain the first electrical wire in spaced relation to the fuel supply line.

By providing a cover which covers the first electrical wire and maintains a spaced relationship between the wire and the fuel supply line, the outboard motor according to the present aspect of the invention provides several advantages. For example, the cover protects the first electrical wire from damage and/or engagement with the cowling. For example, as described above, by covering the first electrical wire, the cowling is prevented from engaging the wire and perhaps dislodging the wire. Additionally, by configuring the cover to maintain a spaced relation between the wire and the fuel supply line, leakage of the electricity from the wire is prevented from passing into the fuel in the fuel supply line and/or prevented from passing to the fuel injector which is fed by the fuel supply line.

An outboard motor constructed in accordance with another aspect of the present invention includes an internal combustion engine and a cowling covering the engine. The engine includes an engine body and an output shaft, the engine body being mounted such that the output shaft rotates about a vertically extending axis. The engine includes first and second protective casings. The first protective casing includes a water-tight seal along at least an upper peripheral edge and houses electrical components that are substantially waterproof. The second protective casing includes a substantially water-tight seal along substantially its entire periphery and includes at least one electrical component that is not waterproof. By providing the outboard motor with two protective casings as such, the cost, complexity, and difficult in servicing the outboard motor is reduced.

Further aspects, features and advantages of the present invention will become apparent from the detailed description of the preferred embodiments which follow.

BRIEF DESCRIPTION OF THE DRAWINGS

The above-mentioned and other features of the invention will now be described with reference to the drawings of preferred embodiments of the present protective covering system for components of an outboard motor. The illustrated embodiments of the system are intended to illustrate, but not to limit the invention. The drawings contain the following figures.

DETAILED DESCRIPTION OF THE PREFERRED EMBODIMENTS OF THE INVENTION

An improved protective covering system for an outboard motor is disclosed herein. The covering system includes an improved design for protecting various components of an engine of an outboard motor.

Figure 1:
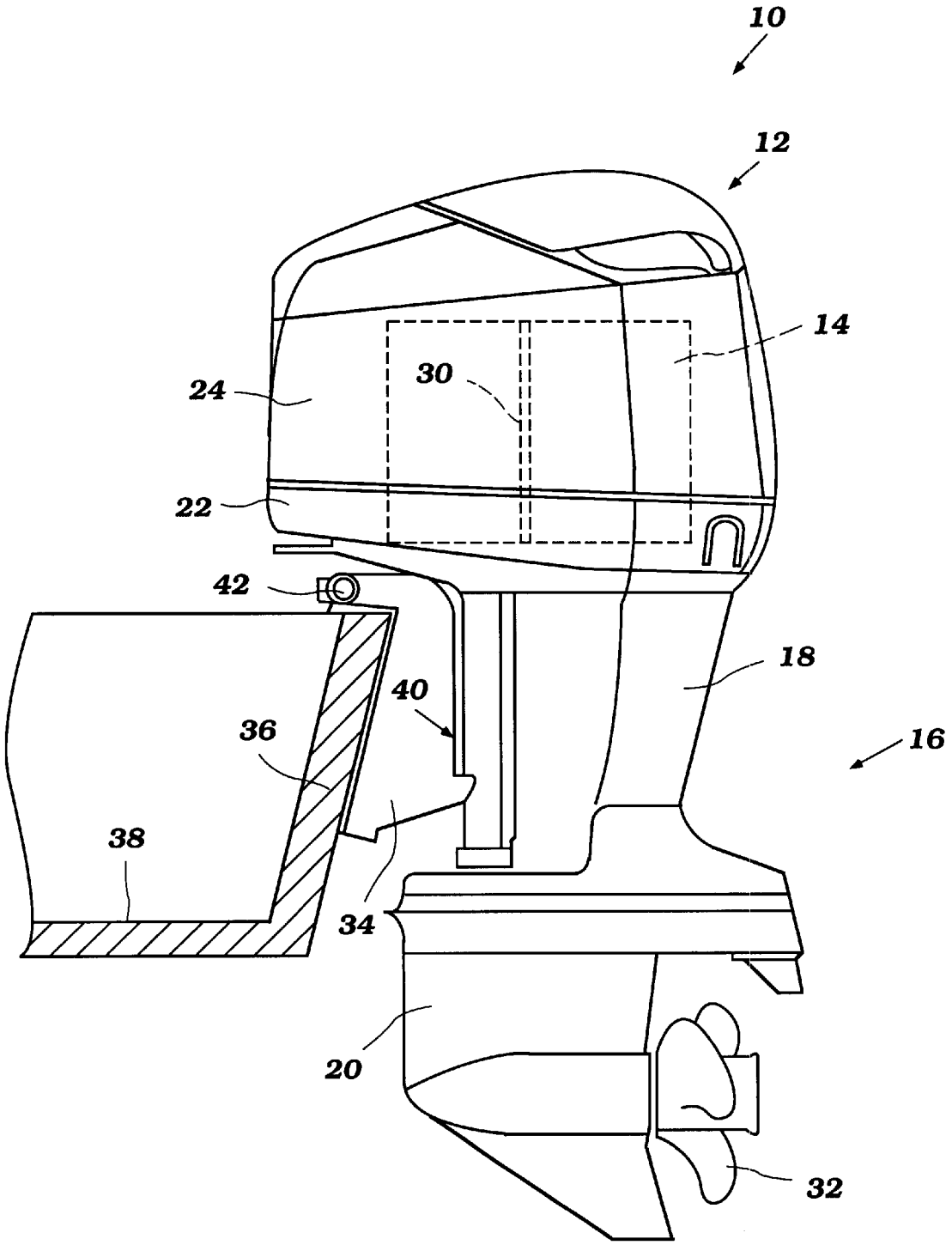
FIG. 1 is a side elevational view of an outboard motor which can include an engine (shown in phantom) having a cover configured in accordance with one aspect of the present invention, the illustrated outboard motor being mounted to a transom of a watercraft (shown partially in section)

With reference to FIG. 1, an outboard motor constructed in accordance with the present invention is identified generally by the reference numeral 10. The outboard motor is comprised of a powerhead indicated generally by the reference numeral 12. The powerhead 12 comprises an internal combustion engine 14, shown in phantom, and is mounted to the upper end of a propulsion unit 16.

The propulsion unit 16 includes a drive shaft housing 18 and a lower unit 20 which may be formed integrally or from two separate parts. The illustrated embodiment shows the drive shaft housing 18 as being separate from the lower unit 20. Typically, the drive shaft housing 18 is formed as a casting of a lightweight material such as aluminum or aluminum alloy. The lower unit 20 is provided at the lower end of the drive shaft housing 18.

The engine 14 in the illustrated embodiment is a fuel injected, V-type, six-cylinder, two-stroke crankcase compression engine. This engine type, however, is merely exemplary. Those skilled in the art will readily appreciate that the present invention can be practiced with a variety of other engine types having other numbers of cylinders, having other cylinder configurations (in-line or W-type) and operating on other combustion principles (e.g., four-stroke and rotary principles).

The engine 14 is supported on a lower tray or lower cowling 22 which forms a portion of the protective cowling that encircles and protects the engine 14. The cowling is completed by an upper cowling member 24 which is detachably affixed to the lower cowling 22 with a number of hooks 26, 28 as is well known in the art.

Figure 2:
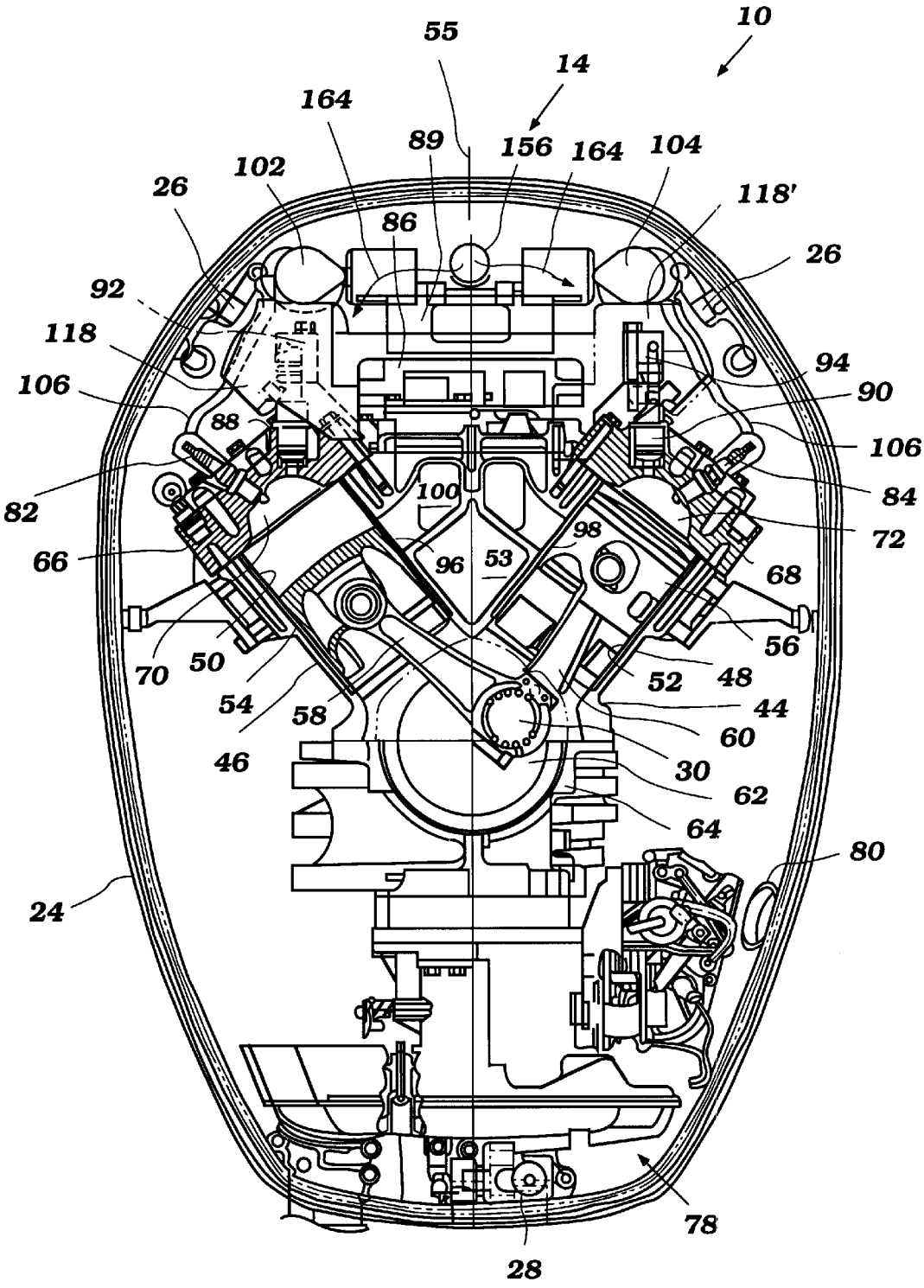
FIG. 2 is a top plan and partial cutaway view of the outboard motor shown in FIG. 1.

With reference to FIG. 2, the illustrated embodiment of the outboard motor 10 includes three hooks, i.e., two rear hooks 26 and a single front hook 28. The construction of the hooks 26, 28 is well known in the art and thus, a further description of the hooks 26, 28 is not necessary for one of ordinary skill in the art to practice the invention as disclosed herein.

With reference to FIG. 1, the engine 14 is oriented in the powerhead 12 such that its output shaft 30 rotates about a generally vertically extending axis. The output shaft 30 is coupled in a known manner to a driveshaft (not shown) that depends through the driveshaft housing 18 and into the lower unit 20. The driveshaft is journaled in any suitable manner. At its lower end, the driveshaft is coupled to a forward, neutral, reverse transmission (not shown). The driveshaft terminates in a gear set which transmits torque from the vertically extending driveshaft to a horizontally extending impeller shaft (not shown). A propeller 32 is driven by the impeller shaft.

The transmission, of which the details are not shown, is controlled in a known manner by a shift rod which is journaled for rotatable support in the lower unit 20. The shift rod is connected to a shift cam for actuation of the transmission in a known manner. The transmission couples the driveshaft to the impeller shaft on which the propeller 32 is affixed so as to rotate about a propeller axis in a known manner. The preferred embodiment illustrates an outboard motor with a conventional propeller 32. Nevertheless, any propulsion device can be utilized with the present invention.

The engine 14 is preferably water cooled and the water for the cooling system is drawn from the body of water in which the outboard motor 10 is operating. The cooling water is emitted through a water inlet opening formed in lower unit 20. A water pump (not shown) is mounted at the interface between the driveshaft housing 18 and the lower unit 20 and is driven by the driveshaft in a known manner. The water pump draws water through the inlet and delivers it upwardly to the engine 14 through a water supply conduit (not shown).

With reference to FIG. 1, the outboard motor 10 also includes a clamping bracket 34 which is adapted to engage the rear of a transom 36 of an associated watercraft 38. A clamping device (not shown) such as a transom screw is also carried by the clamping bracket 34 and cooperates to affix the clamping bracket 34 to the transom 36 in a well known matter.

A steering shaft 40 is attached to the outboard motor 10 by upper and lower bracket assemblies (not shown) in a known manner. The steering shaft is supported for steering movement within a swivel bracket so as to pivot about a vertical steering axis. The steering axis is juxtaposed slightly forward of the driveshaft axis 46. A tiller or steering arm may be affixed to the upper end of the steering shaft for steering the upward motor 10 through an arc. The swivel bracket is connected by a pivot pin 42 to the bracket 34. The pivot pin 42 permits tilt and trim movement of the swivel bracket and the outboard motor 10 relative to the transom 36 of the watercraft 38.

A hydraulic tilt and trim mechanism (not shown) may also be pivotally connected between the swivel bracket and the clamping bracket 34, for effecting the hydraulic tilt and trim movement, and for permitting the outboard motor 10 to pop up when an underwater obstacle is struck. As is well known, these types of hydraulic mechanisms permit the outboard motor 10 to return to its previous trim position once such an underwater obstacle is cleared.

With reference to FIG. 2, the construction of the engine 14 will now be described in more detail. As has been noted, the engine 14 is a V-type engine and, accordingly, includes an engine body 43 defining a cylinder block 44 having a pair of angularly related cylinder banks 46, 48, each of which is formed with a plurality of horizontally extending cylinder bores 50, 52. The cylinder bores 50, 52 may be formed from thin liners that are either cast or otherwise secured in place within the cylinder banks 46, 48. Alternatively, the cylinder bores 50, 52 may be formed directly in the base material of the cylinder banks 46, 48. If a light alloy casting is employed for the cylinder banks 46, 48, such liners can be used.

In the illustrated embodiment, the cylinder banks 46, 48 each include three cylinder bores 50, 52. Since the engine 14 is a V-type engine, the cylinder bores 50, 52 and each cylinder bank preferably are staggered with respect to one another.

Because of the angular inclination between the cylinder banks 46, 48, as is typical with V-type engine practice, a valley 53 is formed between the cylinder banks 46, 48. A longitudinal axis 55 bisects the valley 53.

With reference to FIG. 2, pistons 54, 56 are supported for reciprocation in the cylinder bores 50, 52, respectively. Piston pins connect to the pistons 54, 56 to respective connecting rods 58, 60. At their lower ends, the connecting rods 58, 60 are rotatably journaled to a crankshaft 30 which forms the output shaft 30 of the engine 14.

The crankshaft 30 is, in turn, rotatably journaled to rotate within a crankcase chamber 62. The crankcase chamber 62 is defined at the forward end of engine body 43 by a crankcase member 64 connected to a forward end of the cylinder block 44. The connecting rods 58, 60, as is typical in V-type practice, may be journaled in side-by-side relationship on adjacent throws of the crankshaft 30. That is, pairs of cylinders 50, 52, one from each cylinder bank 46, 48, may have the big ends of their connecting rods 58, 60 journaled in side-by-side relationship on adjacent crankshaft throws. This is one reason why the cylinder bores 50, 52 of the cylinder banks 46, 48 are staggered relative to each other. In the illustrated embodiment, however, separate throws are provided for the cylinders of each of the cylinder banks 46, 48. The throw pairs are nevertheless disposed between main bearings (not shown) of the crankshaft 30 to maintain a compact construction.

At the rear end of the engine body 43, the cylinder bores 50, 52 are closed by cylinder head assemblies 66, 68, respectively. The cylinder head assemblies 66, 68 are provided with individual recesses which cooperate with the respective cylinder bores 50, 52 and the heads of the pistons 54, 56 to form combustion chambers 70, 72, respectively.

These recesses are surrounded by lower cylinder head surface that is planar and held in sealing engagement with either the cylinder banks 46, 48 or with a cylinder head gasket (not shown) interposed therebetween, in a known manner. These planar surfaces of the cylinder head assemblies 66, 68 may partially override the cylinder bores 50, 52 to provide a squish area, if desired. The cylinder head assemblies 66, 68 are affixed in any suitable manner to the cylinder banks 46, 48.

An induction system for the engine 14, indicated generally by the reference numeral 78, is positioned on the forward end of the engine 14. The induction system 78 includes an air silencing and inlet device. The inlet device is contained within the cowling and preferably has a rearwardly facing inlet opening through which air is introduced. Air is admitted into the interior of the cowling in a known manner, and this is primarily through at least one air inlet 80 that has a construction which is generally well known in the art.

The air inlet device supplies air into at least one throttle body which may be formed integrally with an intake manifold. Each throttle body includes a throttle valve which may be in the form of a butterfly-type valve. If a plurality of throttle bodies are used, the throttle valves are linked to each other for simultaneous opening and closing of the throttle valves in a manner that is well known in the art.

As is also typical in two-cycle engine practice, reed-type check valves (not shown) control the induction of air from the intake manifold into the crankcase chamber 62. These check valves permit the air to flow into individual sections of the crankcase chamber when the pistons are moving upwardly in their respective cylinder bores 50, 52. However, as the pistons 54, 56 move downwardly, the charge will be compressed in the sections of the crankcase chamber. At that time, the reed-type check valve will close so as to cause the charge to be compressed. In addition, a lubricant pump may be provided for spraying lubricants stored in a lubricant tank (not shown) into the crankcase chamber 62 and/or the throttle body for purposes of engine lubrication. Although it is not shown, some forms of direct lubrication may also be employed for delivering lubricant directly to certain components of the engine 14.

A charge which is compressed in the sections of the crankcase chamber 62 is then transferred to the combustion chambers 70, 72 through a scavenging system (not shown) in a manner that is well known.

A sparkplug 82, 84 is mounted in each cylinder head assembly 66, 68 for each cylinder bore 50, 52. An electronic control unit (ECU) 86 receives certain signals for controlling the timing of firing of the sparkplugs 82, 84 in accordance with any desired control strategy.

The sparkplugs 82, 84 ignite a fuel air charge that is formed by mixing fuel directly with the intake air via a fuel injector 88, 90, one of which is connected to each combustion chamber 70, 72. The fuel injectors 88, 90 are solenoid type injectors and are electrically operated. They are mounted directly into the cylinder head 66, 68 so as to provide optimum fuel vaporization under all running conditions.

Fuel is supplied to the fuel injectors 88, 90 by a fuel supply system. The fuel supply system is composed of a main fuel supply tank (not shown) that is typically provided in the hull of the watercraft 38 with which the outboard motor 10 is associated. Fuel is drawn from this tank through a conduit by a pump and is delivered to a vapor separator. From the vapor separator, a high pressure electric fuel pump supplies pressurized fuel to a pair of fuel rails 92, 94 at a pressure of, for example, 50–100 kg/cm$^2$ or more. As is well known in the art, the high pressure fuel pump may be electrically or mechanically driven.

The pressure in the fuel rails 92, 94 is regulated by a high pressure regulator (not shown) which dumps fuel back to the vapor separator through a pressure relief line in which a fuel heat exchanger or cooler desirably is provided.

After the fuel charge has been formed in the combustion chamber 70, 72 by injection of fuel from the fuel injectors 88, 90, the charge is ignited by firing the sparkplugs 82, 84, as noted above. The injection timing and duration, as well as control for the timing of the firing of the sparkplugs 82, 84, are controlled by the ECU 86.

Once the charge burns and expands, the pistons are driven downwardly within the cylinder bores 50, 52 until the pistons 54, 56 reach their lowermost position. As the pistons 54, 56 are driven downwardly, exhaust ports 96, 98 are uncovered so as to open communication with an exhaust manifold 100 formed in the cylinder block 44.

The exhaust gases flow through the exhaust passages to collector sections of the exhaust manifold 100. These exhaust manifold collector sections communicate with the exhaust passages formed in an exhaust guide plate (not shown) on which the engine 14 is mounted.

With reference to FIG. 1, the engine 14 discharges the exhaust gases from the exhaust manifold 100 and down into a silencing arrangement provided with an internal cavity in the driveshaft housing 18 through an exhaust pipe (not shown). The exhaust pipe extends into an expansion chamber formed at the rear of the driveshaft housing, also not shown. The expansion chamber terminates at its lower end in an exhaust gas discharge formed in the lower unit 20 for delivering the exhaust gases to the atmosphere, through the body of water in which the associated watercraft 38 is operating. Although the preferred embodiment illustrates an exhaust passage through the hub, any type of conventional above the water exhaust gas discharge may be used with the present invention. For example, the exhaust discharge may include an underwater, high speed exhaust gas discharge and an above-the-water, low speed exhaust gas discharge.

Any type of desired control strategy can be employed for controlling the time and duration of fuel injection from the fuel injectors 88, 90 and the timing of the firing of the sparkplugs 82, 84. It is to be understood that those skilled in the art will readily understand how various control strategies can be employed in conjunction with the components of the invention.

The control for the fuel/air ratio preferably includes a feedback control system. Thus, a combustion condition sensor, such as an air/fuel ratio sensor box (not shown) can be provided to sense the in-cylinder combustion conditions by sensing the air/fuel ratio of the fuel/air mixture delivered to the cylinder bores 50, 52. For example, the sensor box may be in the form of an oxygen sensor which senses the in-cylinder combustion products conditions by sensing the residual amount of oxygen in the combustion products at a time near the time when the exhaust port is open. An output signal produced by the sensor box is directed to the ECU 86 by an electric conduit or wire. Engine load, as determined by a throttle angle of the throttle valve contained in the induction system 78, is sensed by a throttle position sensor (not shown) which outputs a throttle position or a load signal to the ECU 86 via an electrical wire or conduit (not shown). Preferably there is also provided a fuel pressure sensor (not shown) communicating with a fuel supply line such as the fuel rails 92, 94. This pressure sensor outputs a high pressure fuel signal to the ECU 86 via an electrical conduit or wire (not shown).

There also may be provided a water temperature sensor which outputs a cooling water temperature signal to the ECU 86 via an electrical control conduit or wire (not shown). Further, an intake air temperature sensor may be provided to generate and direct an intake air temperature signal to the ECU 86 (via an electrical conduit or wire).

There is also provided a crank angle position sensor (not shown) associated with the crankshaft 30, which when measuring crank angle versus time, outputs an engine speed signal to the ECU 86 via an electrical wire or conduit (not shown).

Conditions sensed by the various sensors are merely some of those conditions which may be sensed for engine control and it is, of course, practicable to provide other sensors such as, for example, but without limitation, an engine height sensor, a trim ankle sensor, a knock sensor, a neutral sensor, a watercraft pitch sensor, and an atmosphere temperature sensor in accordance with various control strategies.

Figure 3:
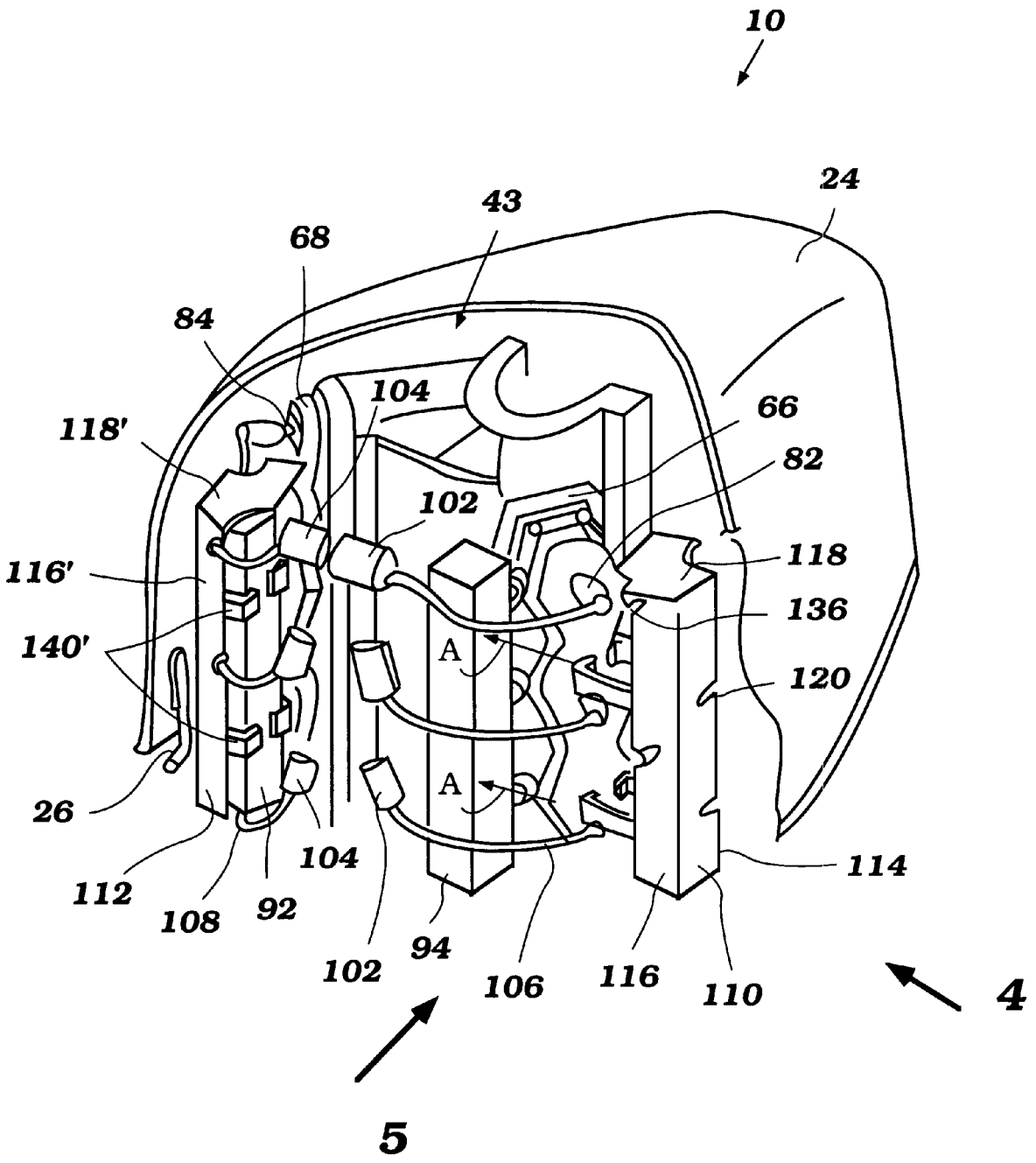
FIG. 3 is a top, rear, and left side perspective and partial cutaway view of the outboard motor shown in FIG. 1 illustrating protective covers connected to each cylinder bank, the left side cover being shown in an exploded view.

The ECU 86, as has been noted, outputs signals to the fuel injectors 88, 90, sparkplugs 82, 84, and the high pressure fuel pump, for example, for their respective control. Preferably, a separate fuel injection controller 89 is provided for controlling fuel injection and duration. In the illustrated embodiment, the fuel injection controller 89 output signals to the fuel injectors 88, 90 according to any known control strategy. These control signals are carried by respective control lines which are not shown in the figures, however, but which are well known in the art. In the illustrated example, as shown in FIG. 3, a separate ignition coil 102, 104 is provided for each sparkplug 82, 84. An ignition wire 106, 108 extends between each ignition coil 102, 104 and each sparkplug 82, 84, respectively. As shown in FIG. 3, at least a portion of each ignition wire 106, 108, extends substantially horizontally around an outer periphery of the engine body 43.

In order to protect the ignition wires 106, 108, covers 110, 112 are also provided, the construction of which will be described in detail below. FIG. 3 illustrates the cover 112 being connected to the fuel rail 92 while the cover 110 is removed from the fuel rail 94.

As shown in FIG. 3, each of the covers 110, 112 is formed of sidewalls 114, 116 and an upper wall 118, together defining an outer surface of the cover 110. The construction of the cover 112 is essentially identical to that of the construction of the cover 110. Thus, the reference numerals used to indicate the various components of the cover 112 are the same as those used to identify the corresponding components of the cover 110, however, a "'" has been added. Additionally, since the cover 112 is used to cover the fuel rail 92 which is on the opposite side of the longitudinal axis 76, the construction of the cover 112 is a mirror image of the construction of the cover 110. Thus, the following description of the cover 110 is sufficient for one of ordinary skill in the art to understand show to practice the invention.

Figure 4:
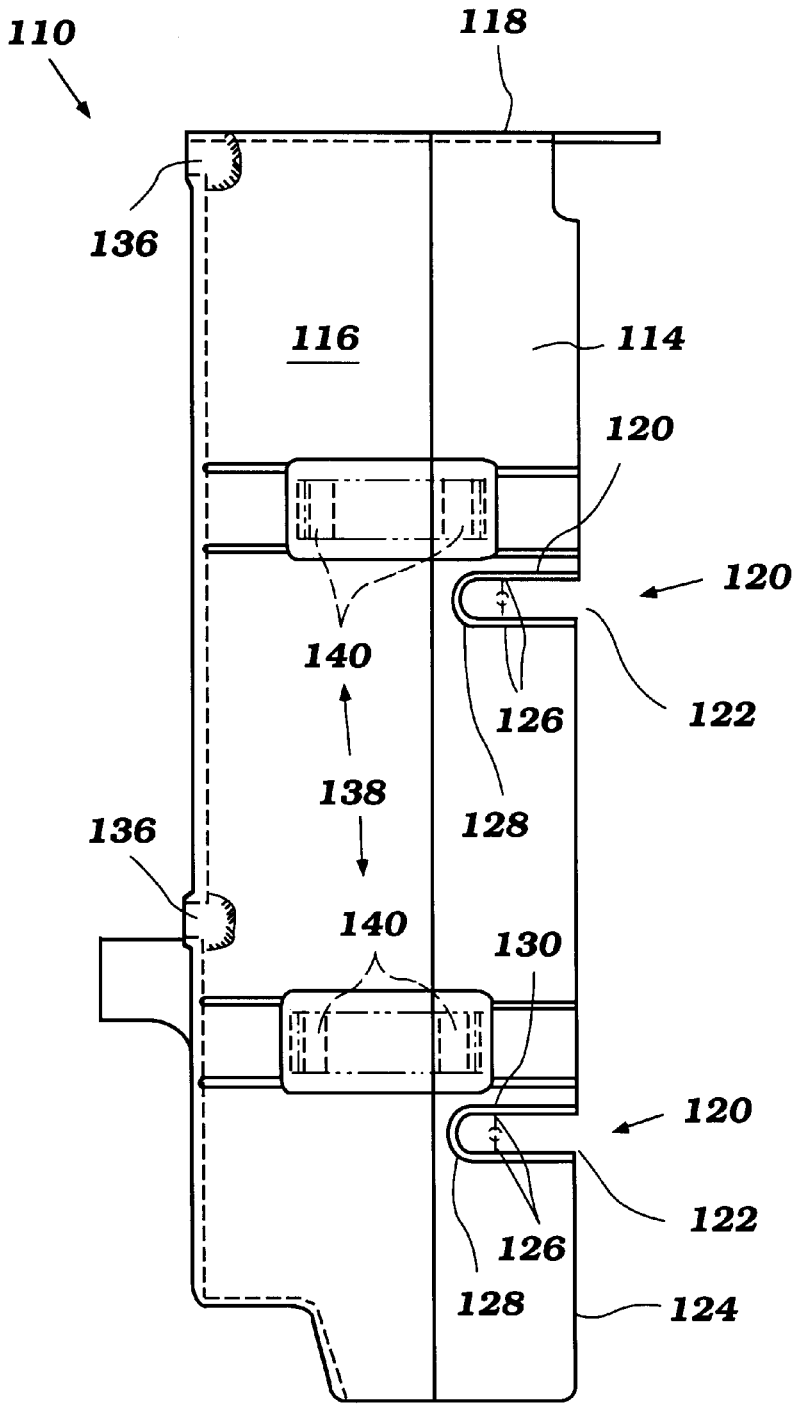
FIG. 4 is an elevational view of one of the covers illustrated in FIG. 3 as viewed along the direction indicated by arrow 4.

FIG. 4 illustrates a side elevational view of the cover 110 as viewed along the direction indicated by arrow 4 illustrated in FIG. 3. As shown in FIG. 4, the sidewall 114 of the cover 110 includes receptacles 120. The receptacles 120 comprise slots in the wall 114 having an open end 122 along a free edge 124 of the wall 114. The receptacles 120 also include beads 126 formed between the open ends 122 and the inner ends 128 of the receptacles 120.

Preferably, the beads 126 are sized so as to form constrictions 130 within the receptacles 120. The constrictions 130 may be configured so as to engage an ignition wire or other electrical wire. For example, an ignition wire typically has insulation around an outer surface of an electrical conduit. The size of the constrictions 130 preferably are slightly smaller than the outer diameter of the insulation on the ignition wires 106 in a relaxed state. Thus, the ignition wires 106 can be moved into the receptacles 120 between the restrictions 130 and the closed ends 128 of the receptacles 120 such that the receptacles 120 engage the ignition wires 106. As such, the constrictions 130 along with the closed end 128 of the receptacles 120 form an engaging device for releasably engaging the ignition wires 106.

Figure 5:
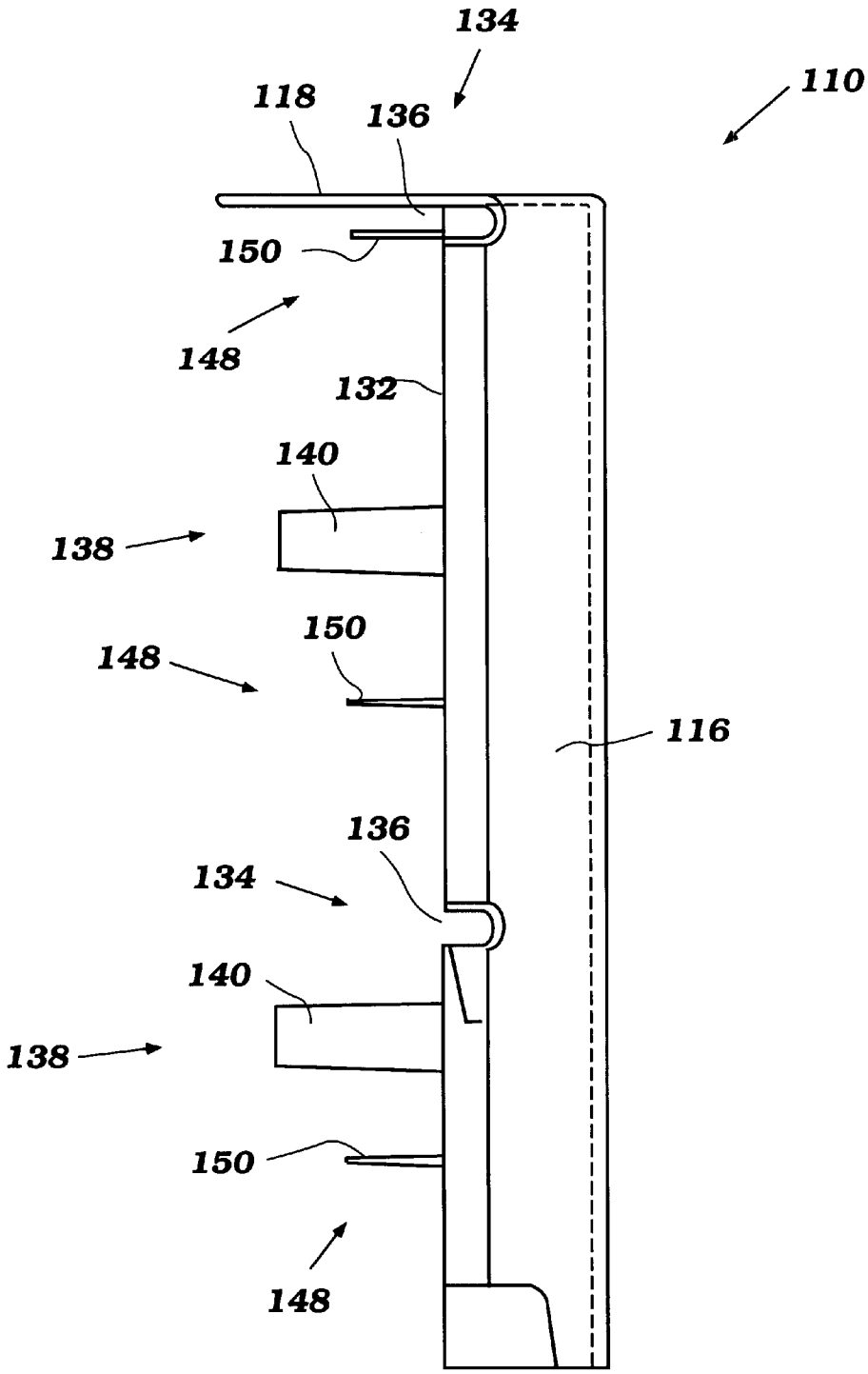
FIG. 5 is an elevational view of the cover illustrated in FIG. 4.

With reference to FIG. 5, the wall 116 includes a free edge 132. The wall 116 also includes a plurality of receptacles 134 which have an open end 136 along the free edge 132 of the wall 116. The construction of the receptacles 134 may be identical to the receptacles 120 illustrated in FIG. 4. For example, the receptacles 134 may optionally include beads forming a constriction or other features which cooperate with the receptacle 134 to form engaging devices for engaging electrical wires such as the ignition wires 106.

Figure 6:
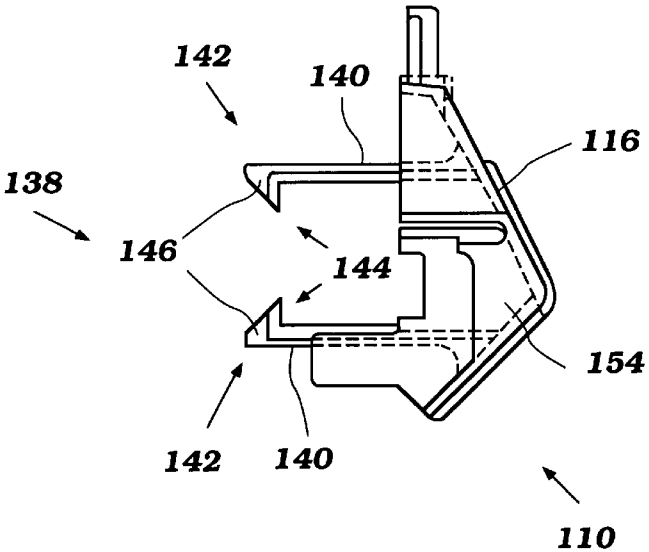
FIG. 6 is a bottom plan view of the cover illustrated in FIG. 4.

With reference to FIGS. 4, 5 and 6, the cover 110 also includes at least one engagement device 138 configured to connect the cover 110 to the engine 14. In the illustrated embodiment, the engagement devices 138 each comprise a pair of hooks 140 connected to the wall 114 and/or 116. As shown in FIG. 6, the hooks 140 of the illustrated embodiment are formed monolithically with the walls 116 and 114.

Free ends 142 of the hooks 140 include barbs 144. The outer surfaces 146 of the barbs 114 are tapered inwardly. As such, as shown in FIG. 3, the cover 110 may be pushed onto the fuel rail 94 and engaged therewith. For example, by pushing the cover 110 toward the fuel rail 94 along the direction indicated generally by the arrows labeled A in FIG. 3, the tapered surfaces 146 cause the hooks 140 to move away from each other, as viewed in FIG. 6, as the tapered surfaces 146 contact the fuel rail 94. After the barbs 144 have reached the opposite side of the fuel rail 94, the hooks 140 move toward each other due to their own resiliency. For example, the hooks 140' illustrated on cover 112 of FIG. 3 are shown in the fully installed state engaged with a fuel rail 92. Of course, other engaging devices can be used to engage the covers 110, 112 with the fuel rails 94, 92 respectively, such as, for example, but without limitation, threaded fasteners, tabs, clips, buttons, snaps, and the like.

Figure 7:
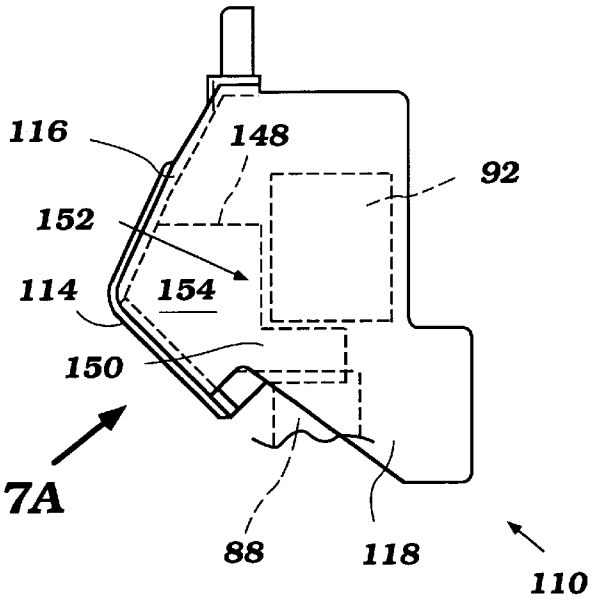
FIG. 7 is a top plan view of the cover illustrated in FIG. 4.
Figure 7A:
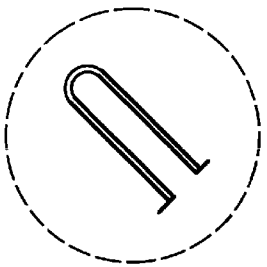
FIG. 7A is an enlarged elevational view of a slot included on the cover as viewed along line, illustrated in FIG. 7.

With reference to FIG. 7, the upper wall 118 of the cover 10 is shown in top plan view. Additionally, a fuel injector 88 communicating with the fuel rail 92 is illustrated schematically. As shown in FIG. 7, the upper wall 118 of the cover 110 extends above the upper end of the fuel rail 92 as well as at least a portion of the fuel injector 88.

With reference to FIG. 5, the cover 110 also includes the projections 148 projecting from an inner surface of the cover 110. In the illustrated embodiment, the projections 148 extend inwardly from the walls 116, 114. The projections 148 include a visor portion 150. As shown in FIG. 7, the visor portion 150 of the projection 148 is configured to extend above at least a portion of the fuel injector 88. Additionally, the projection 148, in the illustrated embodiment, includes an alignment portion 152. The alignment portion 152 aids in maintaining the alignment between the walls 114, 116 and the fuel rail 92 as well as maintaining a gap between the fuel rail 92 and the inner surface of the walls 114, 116. In the illustrated embodiment, the visor portion 150 and the alignment portion 152 are formed by an L-shaped plate 154.

With reference to FIG. 5, the cover 110 preferably includes one projection 148 for each fuel injector 88 formed on the corresponding cylinder bank. In the embodiment illustrated in FIG. 5, the cover 110 includes three projections 148, i.e., one projection 148 for each fuel injector 88. Thus, there is one visor portion 150 for each fuel injector 88. As such, each visor portion 150 further protects each individual fuel injector 88 from dripping, splashing, or condensing water which may be present within the cowling 24.

Figure 8:
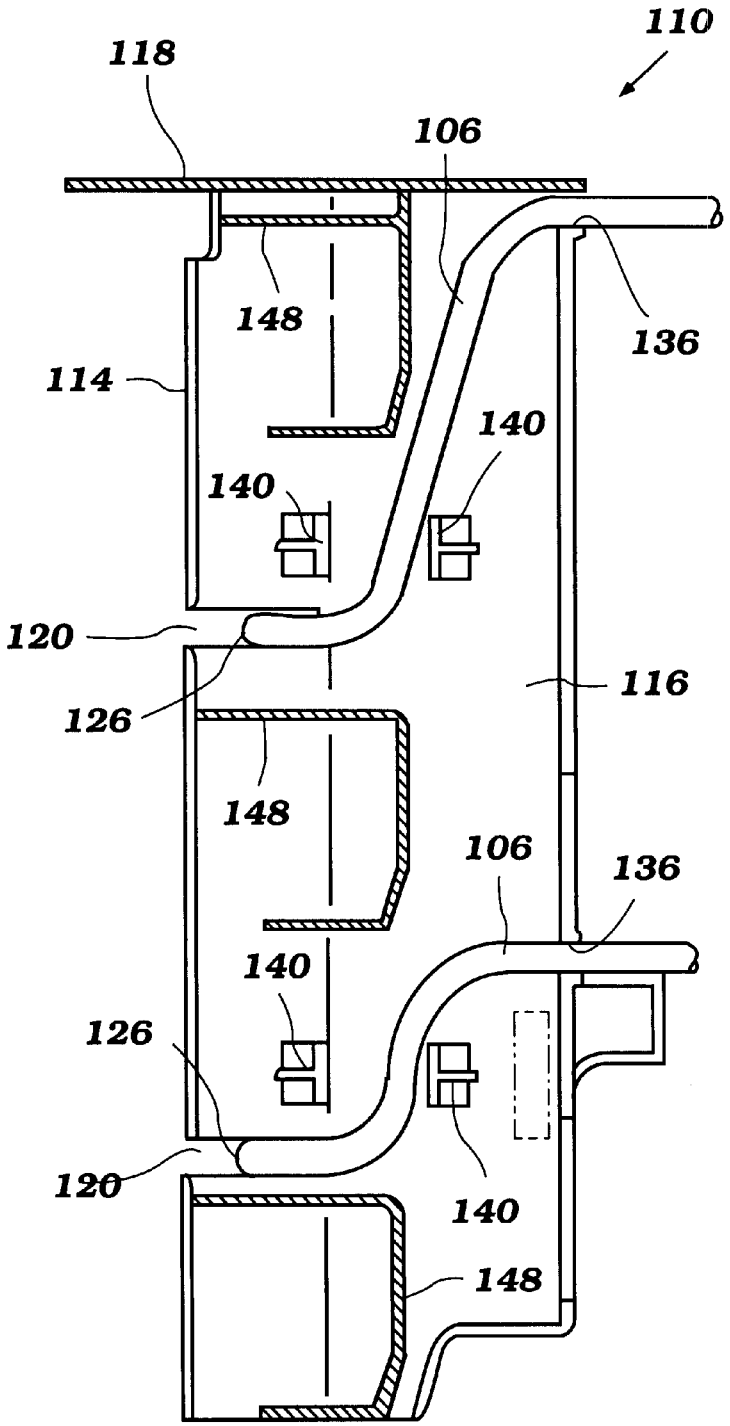
FIG. 8 is an elevational view illustrating the inner surface of the cover shown in FIG. 4.

With reference to FIG. 8, a preferred installation of the cover 110 is illustrated therein. As shown in FIG. 8, the ignition wires 106 are preferably installed so as to extend through the receptacles 120, being engaged by the beads 126, between the hooks 140 and through the receptacles 136. As such, the ignition wires 106 can be anchored in place and maintained in a spaced relation from the fuel rail 92 when the hooks 140 are engaged with the fuel rail 92. Thus, the illustrated embodiment of the cover 110 achieves the dual goals of preventing the ignition wires 106 from being dislodged by the mounting hooks 26 of the cowling 24 while maintaining a gap between the ignition wires 106 and the fuel rail 92.

With reference to FIG. 2, and as noted above, the ECU 86 is mounted at a rear of the valley portion 53. Rearward from the ECU 86, the fuel injection controller 89 is mounted for controlling injection timing and duration. As shown in FIG. 2, a protective sleeve 156 is mounted to the engine, rearward from the fuel injection controller 89.

Figure 9:
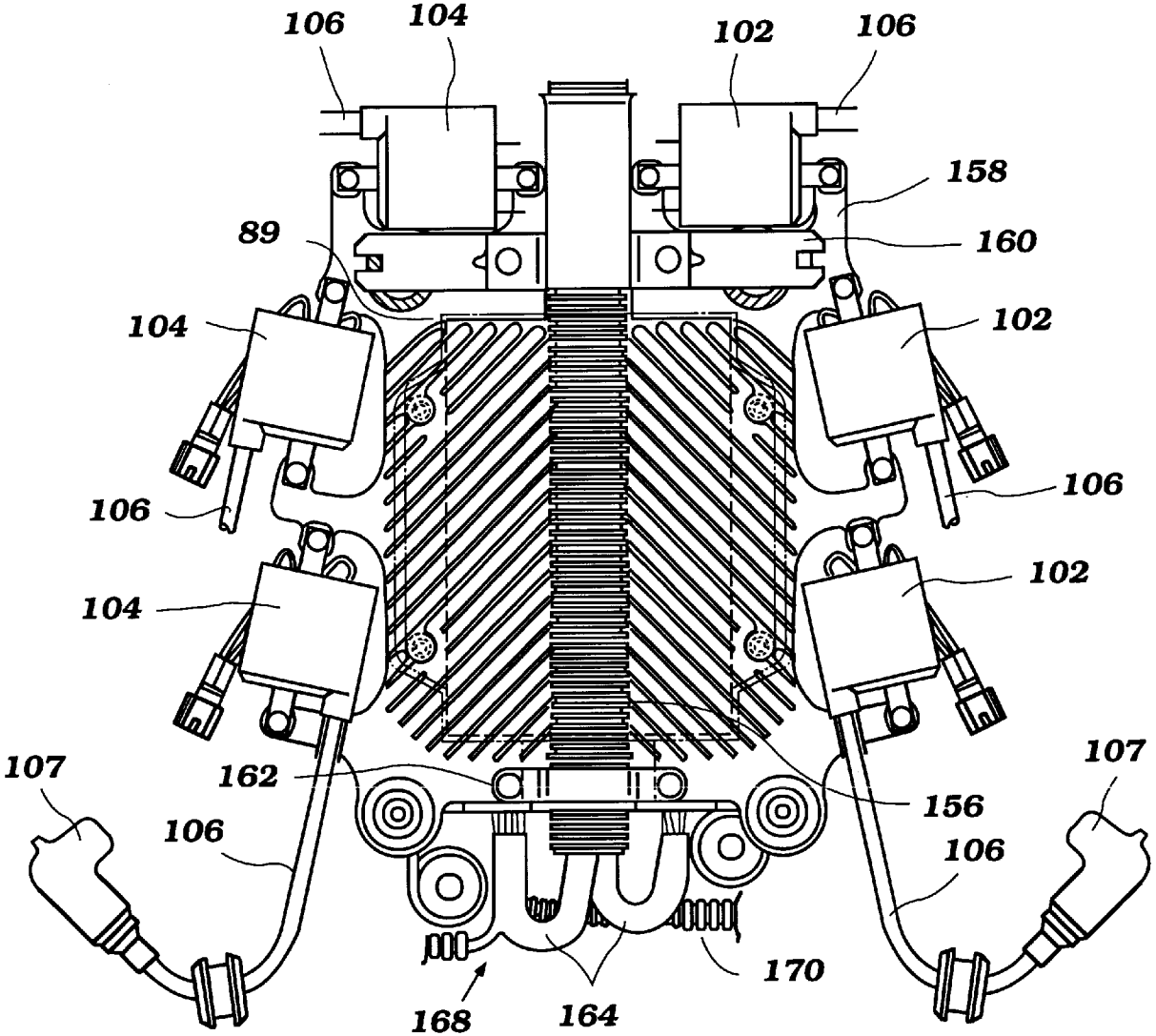
FIG. 9 is a partial rear elevational view of the engine of the outboard motor shown in FIG. 2 and a protective tube.

As shown in FIG. 9, the protective sleeve 156 extends between a lower end and an upper end of the engine 14. In the illustrated embodiment, the protective sleeve 156 is made from a tubular ribbed material, however, any type of sleeve may be used. As shown in FIG. 9, a mounting bracket 158 supports the protective sleeve 156 via an upper bracket 160 and a lower bracket 162.

Figure 10:
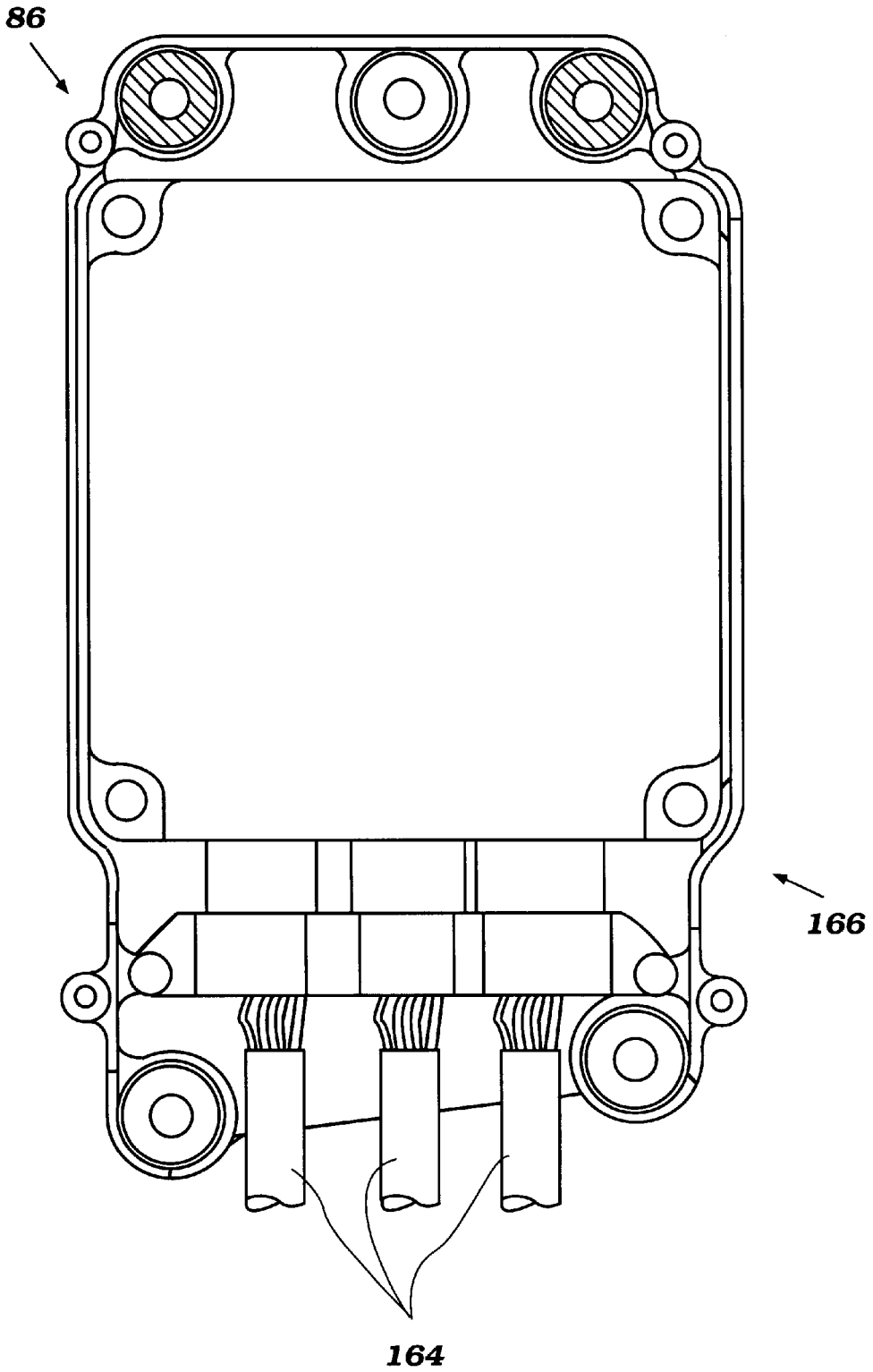
FIG. 10 is a rear elevational view of an electronic control unit connected to the engine shown in FIG. 2.

With reference to FIG. 10, the ECU 86 is connected to the various other electronic components of the outboard motor 10 via electrical wires 164. Preferably, the ECU 86 is oriented such that the electrical conduits extend from a lower end 166 of the ECU 86. As shown in FIG. 9, the electrical wires 164 extend downwardly from the ECU 86 and may include branches, such as branches 168, 170 and then are bent upwardly into the protective sleeve 156. These electrical wires pass through the sleeve 156 to the upper end of the engine 14.

With reference to FIG. 2, the electrical wires 14 extend from the upper end of the protective sleeve 156 to an upper end of the engine 14. From the upper end of the protective sleeve 156, the electric wires 164 extend to other electrical components on the upper end of the engine 14 or extend downwardly from the upper end of the engine to other electrical components that are mounted below the upper end of the engine 14. For example, the wires 164 may extend to a starter motor (not shown), a fuel pump (not shown), and/or the other various sensors described above, such as, for example, but without limitation, an oxygen sensor, a throttle valve position sensor, an air temperature sensor, coolant temperature sensor, and the like.

By including the protective sleeve 156 as such, the electric wires 164 which extend to various electrical components of the engine are prevented from contacting water which may collect in the powerhead 12 of the outboard motor 10. In particular, the sleeve 156 prevents wires 164 from sagging downwardly and contacting water that may collect in the lower tray or cowling 22. Furthermore, because the protective sleeve 156 is mounted rearward from the ECU 86 and the fuel injector control 89, the maintenance and repair of the electrical wires 164 is made easier.

As noted above, the electrical wires 164 extending from the upper end of the protective sleeve 156 may extend downwardly from the upper end of the engine 14 to further electronic devices. For example, some of the electrical wires 164 may extend to relays used to control certain components of the engine.

Figure 11:
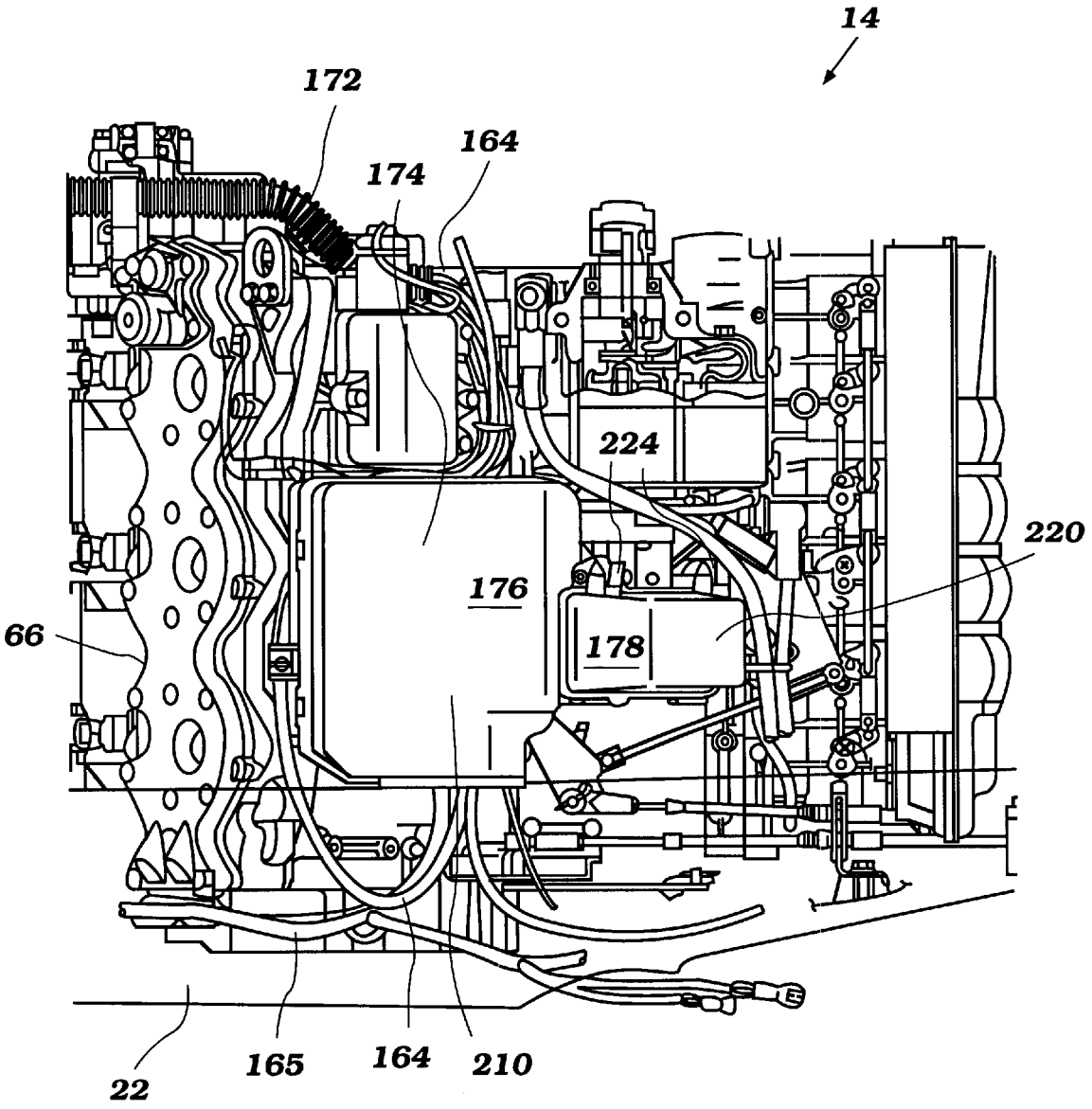
FIG. 11 is a side elevational view of a modification of the outboard motor shown in FIG. 1, with the protective cowling removed and illustrating a protective casing for electric components having outer cover members.

With reference to FIG. 11, an extension 172 of the protective sleeve 156 is illustrated therein. As shown in FIG. 11, the extension 172 extends from a rearward end of the engine 14, and over an upper end of the cylinder head assembly 66. The wires 164 extend from the open end of the extension 172 downwardly to other various components of the engine. For example, some of the wires 164 extend into a protective case 174 for electrical components. Additionally, other electrical wire 165 extend from a lower end of the engine 14 and upwardly into the protective case 174.

Figure 12:
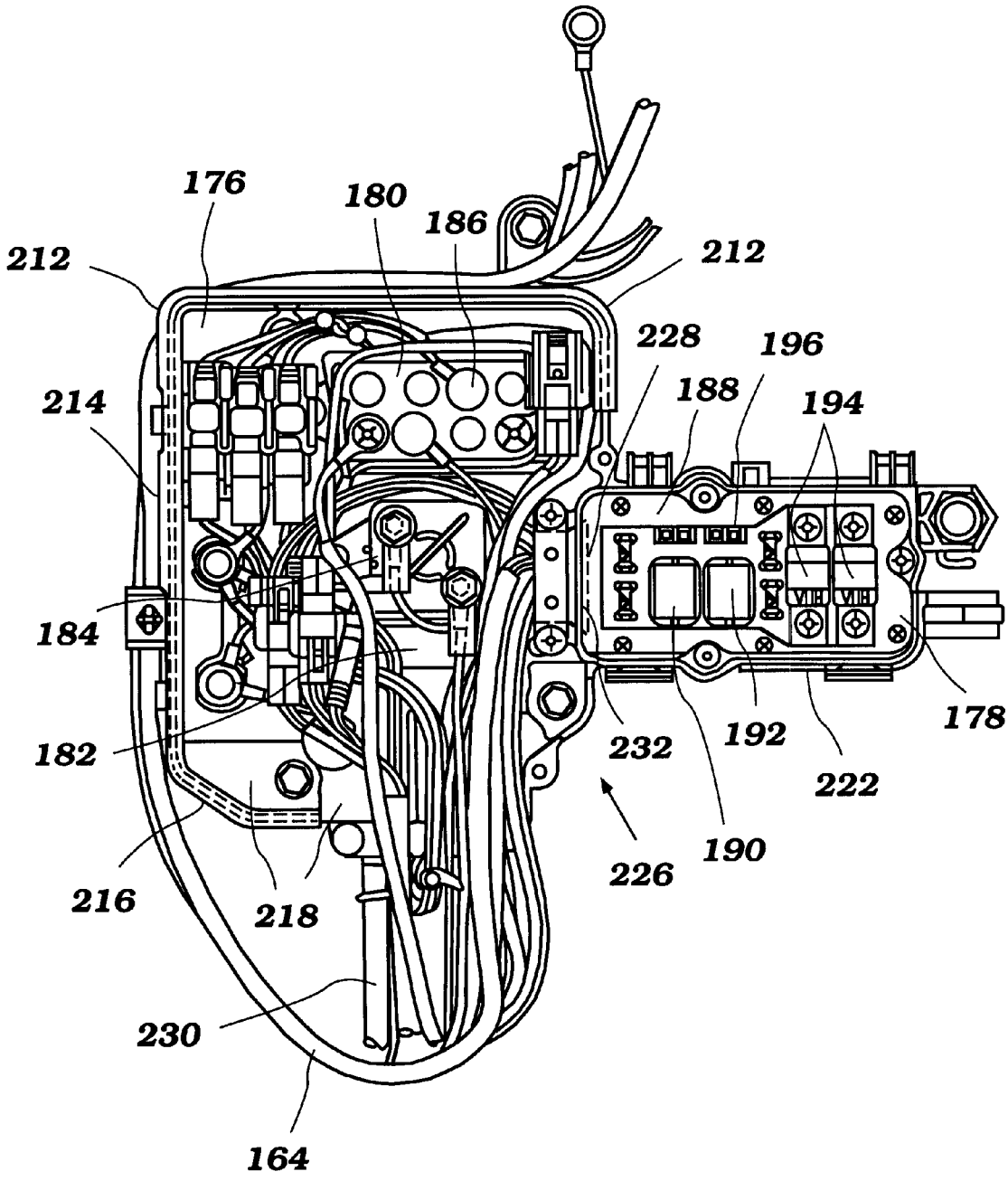
FIG. 12 is a front elevational view of the protective casing illustrated in FIG. 12 with the outer cover members removed.

The protective case 174 includes a main portion 176 and subportion 178. With reference to FIG. 12, the main portion 176 houses electrical components which are substantially waterproof. For example, commonly available electrical components that are substantially waterproof include, but without limitation, a relay 180 for a power trim or tilt mechanism, a rectifier 182, a relay 184 for a starter motor, and the like. As illustrated in FIG. 12, the substantially waterproof relays 180, 182, 184 are connected to various other components and electrical wires with waterproof connectors, such as, for example, but without limitation, a waterproof coupling boot 186. Although the relays 180, 182, 184 are substantially waterproof, it is beneficial to house these components within a splash-proof case. In the illustrated embodiment, the main portion 176 of the protective case 174, the construction of which will be described in detail below, acts as a splash-proof box. However, certain other kinds of electrical components including relays and fuses, are not readily available in waterproof form. Furthermore, it is expensive to construct all electrical components in a waterproof form. Thus, certain other relays and fuses are stored in the subcase 178.

As shown in FIG. 12, the subcase 178 houses other relays and fuses which are useful for the operation of the engine 14. For example, the subcase 178 houses, for example, but without limitation, a relay fuse unit 188 which includes mounting receptacles for an ECU relay 190, a fuel system relay 192 and other fuses 194. An extra fuse 196 is also installed to the fuse unit 188. The relays 190, 192 and the fuses 194 are connected to the various electrical components with electrical conduits such as the wires 164. For example, the ECU relay 190 is connected to the ECU 86 with at least one electrical conduit included in the electrical wire 164. Additionally, some electrical wires connect the fuses 194 and/or the relays 190, 192 with the relays housed in the main case 176.

Figure 13:
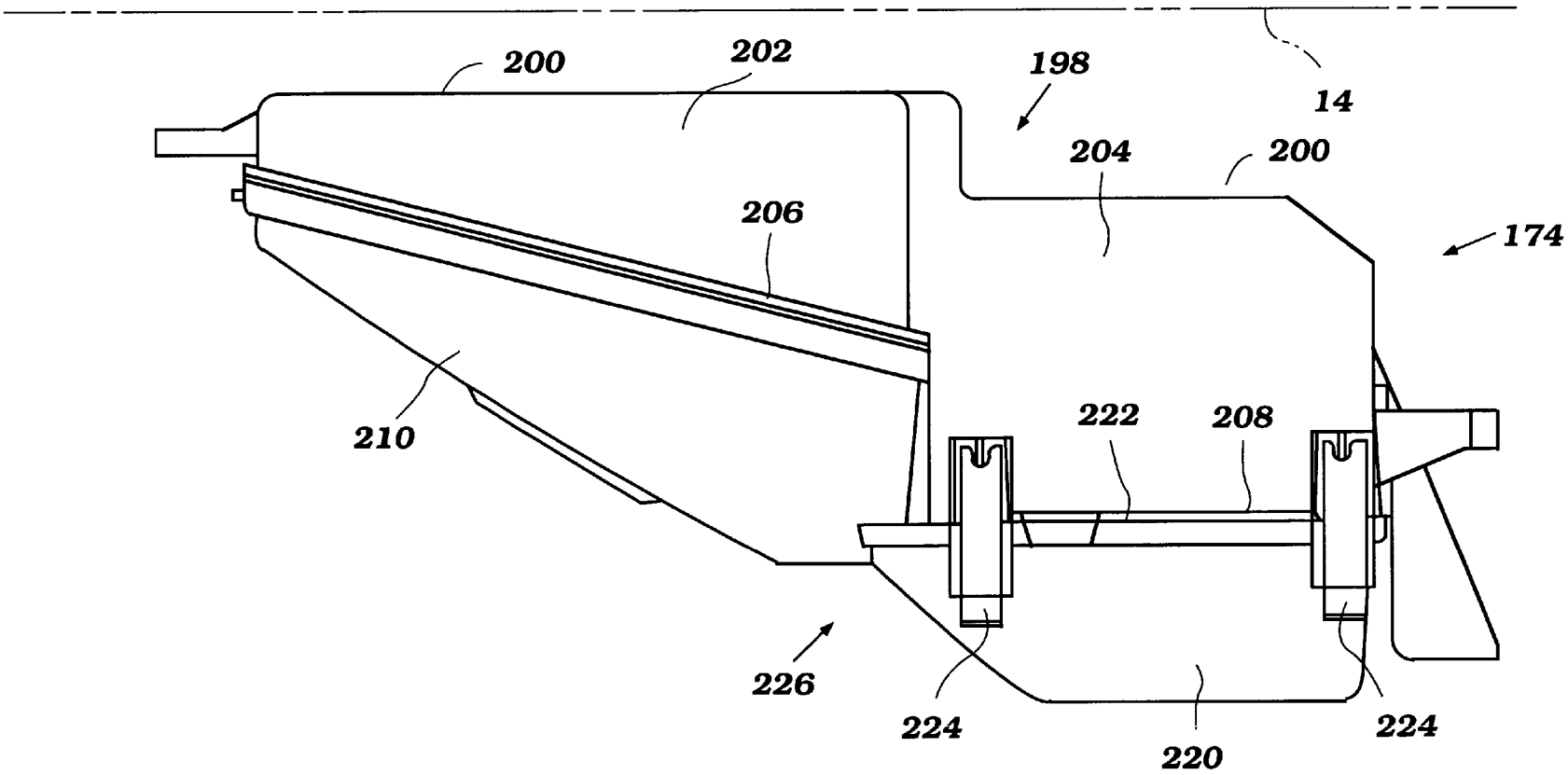
FIG. 13 is a top plan view of the protective casing illustrated in FIG. 11.

With reference to FIG. 13, the protective case 174 comprises a main body 198. The main body 198 includes a rear surface 200. The case 174 preferably is mounted such that the rear surface 200 faces the engine 14. The main body 198 is also divided into a main storage portion 202 and a substorage portion 204. Preferably, the main storage portion 202 and the substorage portion 204 of the main body 198 are formed monolithically.

The main storage portion 202 is generally in the form of a tray having a plurality of sidewalls extending from the rear surface 200 and having an open outer side 206. Similarly, the substorage portion 204 is also in the form of a tray having a plurality of sidewalls extending from the rear surface 200 and having an open outer side 208. The case 174 also includes separate lids for the main storage portion 202 and the substorage portion 204.

A main lid 210 is configured to engage the open outer side 206 of the main storage portion 202. With reference to FIG. 12, the main lid 210 is preferably configured to form a substantially watertight seal at least along the upper edge 212 of the main storage portion 202. In the illustrated embodiment, the watertight seal between the main lid 210 and the open front 206 of the main storage portion 202 extends over the upper edge 212, along a rear edge 214 to a lower edge 216 of the main storage portion 202. The lower edge 216 of the main storage portion 202 also includes an opening 218 through which electrical cables 164 pass into the main storage portion 202. Thus, although the main storage portion does not include a watertight seal around its entire periphery, the main storage portion 202 remains substantially splash-proof due to the watertight connection between the lid 210 and the open outer side 206 along at least the upper edge 212.

The substorage portion 204 includes a lid 220 which forms a substantially watertight seal around substantially an entire periphery 222 of the open outer side 208. In order to maintain the lid 220 in sealed engagement with the open outer side 208, the substorage portion 178 includes fasteners 224. The construction of the fasteners 224 may be in the form of springloaded one-touch clips, threaded fasteners, and/or the like. The construction of such fasteners is well known in the art and thus, a further explanation of the construction of the fasteners 224 is not necessary for one of ordinary skill in the art to practice the invention.

On a rear end 226, of the substorage portion 204 an aperture 228 is provided through which certain electrical cables extend. For example, electrical cables 164 extend from other electrical components such as the ECU 86, through the aperture 228 and into the substorage portion 178 to any one of the relays 190, 192 and/or fuses 194. Other wires extend from these devices 190, 192, 194 through the aperture 228 and perhaps into contact with other relays 180, 182, 184 in the main case 176. Alternatively, other electrical wires may extend directly from the aperture 228 to the opening 218 and extend downwardly from the main casing portion 176, such as the electrical wires 230 for example. The electrical wires 230 then extend to other various electronic components which are connected to the relays 180, 182, 184, 190, 192 or fuses 194, for example.

In order to provide a substantially watertight seal between the aperture 228 and the electrical wires extending through the aperture 228, a grommet 232 is provided in the aperture 228, the construction of which is well known in the art.

Preferably, as illustrated in FIG. 12, the open outer side 208 and the lid 220 are configured such that the aperture 228 falls within the main case 176. As such, the aperture 228 is further protected from splashing or condensing water vapor that may be present in the powerhead 12.

By constructing the case 174 with two compartments, i.e., the main portion 176 having a watertight seal around only a portion of its outer periphery and subcase 178 having a substantially watertight seal around substantially its entire periphery, the present case 174 provides several advantages. For example, although several electrical components are widely available in waterproof form, such as the tilt/trim relay 180, the rectifier 182, and the starter motor relay 184, not every electrical component is available in such a waterproof form. Additionally, it is desirable to use components which are appropriate for any type of internal combustion engine. Thus, a combination of waterproof and nonwaterproof electrical components allows a manufacturer of an outboard motor to reduce costs associated with waterproof electronic components. Additionally, providing all electrical components, waterproof and nonwaterproof, within a watertight box is costly. Thus, by constructing an electrical component box with a main splash-proof portion which does not include a watertight seal around its entire periphery and a subportion which includes a substantially watertight seal around substantially its entire periphery, the present invention reduces the cost associated with protecting electronic components.

Furthermore, by using two independent covers for the main portion 176 and the subportion 178, is easier to service the electrical system. For example, because the available space within the cowling 24 of a powerhead 12 is quite limited, various engine components must be arranged with tight spacing. Additionally, wires, cables, rods, and various covers may overlap one another, thus making the servicing of an individual component more difficult. However, by constructing the protective case 174 with two independent covers 210, 220, it has been found that it is easier to service the electrical components contained therein because the lids 210, 220 are smaller than a single lid which would cover both the main portion 176 and the subportion 178.

Additionally, by arranging the electrical wires, such as the wires 164, 230 so that they extend into the main portion 176 through a lower edge 216, it is less likely that water may travel along one of the electrical wires 164, 230 by surface tension, for example, and into the interior the main portion 176.

Of course, the foregoing description is that of certain features, aspects and advantages of the present invention to which various changes and modifications may be made without departing from the spirit and scope of the present invention. Moreover, an outboard motor may not feature all objects and advantages discussed above to use certain features, aspects and advantages of the present invention. Thus, for example, those skilled in the art will recognize that the invention may be embodied or carried out in a manner that achieves or optimizes one advantage or a group of advantages as taught herein without necessarily achieving other objects or advantages as may be taught or suggested herein. The present invention therefore, should only be defined by the appended claims.

What is claimed is:

1. An outboard motor comprising a powerhead including an internal combustion engine and a cowling covering the engine, the engine having an engine body and an output shaft, the engine being mounted in the powerhead so that the output shaft rotates about a generally vertically extending axis, the engine including a plurality of electrical components and at least a first electrical wire extending between two of the electrical components, at least a portion of the first electrical wire extending transversely to the vertical axis and along an outer periphery of the engine body, and a cover covering the transversely extending portion of the electrical wire.

2. The outboard motor according to claim 1, wherein the first electrical wire comprises an ignition wire.

3. The outboard motor according to claim 2, wherein the two electrical components comprise a coil and a spark plug.

4. The outboard motor according to claim 1 additionally comprising a hook provided on the cowling, the transversely extending portion of the electrical wire extending above the hook when the cowling is arranged over the engine.

5. The outboard motor according to claim 1 additionally comprising a charge former for delivering a fuel amount to the engine body and a fuel supply line configured to deliver fuel to the charge former, the first electrical wire extending between the cover and a fuel supply line.

6. The outboard motor according to claim 5, wherein the cover is configured to maintain a gap between the electrical wire and the fuel supply line.

7. The outboard motor according to claim 5, wherein the cover comprises an inner side and an outer side, at least a first mount connecting the cover to the engine such that the inner side of the cover is spaced from the fuel rail.

8. The outboard motor according to claim 7, wherein the first mount connects the cover to the fuel rail.

9. The outboard motor according to claim 5 additionally comprising at least a first engagement device provided on the cover, the engagement device configured to engage the first electrical wire and maintain the first electrical wire in spaced relation to the fuel rail.

10. The outboard motor according to claim 5, wherein the fuel supply line comprises a fuel rail.

11. The outboard motor according to claim 5, wherein the charge former is a fuel injector.

12. The outboard motor according to claim 1 additionally comprising a fuel injector configured to deliver a fuel charge to the engine body, the cover extending over the fuel injector and along at least one side of the fuel injector.

13. An outboard motor comprising a powerhead including an internal combustion engine and a cowling covering the engine, the engine having an engine body and an output shaft, the engine being mounted in the powerhead so that the output shaft rotates about a generally vertically extending axis, at least a first charge former configured to deliver a fuel charge to the engine body, a fuel supply line supplying fuel to the charge former, a plurality of electrical components, at least a first electrical wire connecting two of the electrical components and extending transverse to the fuel supply line, a cover covering at least a portion of the fuel supply line, the first electrical wire extending between the cover and the fuel supply line, and at least a first engagement device provided on the cover, the engagement device configured to engage the first electrical wire and maintain the first electrical wire in spaced relation to the fuel supply line.

14. The outboard motor according to claim 13, wherein the first engagement device comprises a slot having first and second ends, the first end begin open along an edge of the cover, the second end having a constricted portion being sized to releasably engage the first electrical wire.

15. The outboard motor according to claim 13 additionally comprising at least a first projection extending from an inner surface of the cover, the first projection maintaining a gap between the inner surface and the fuel supply line.

16. The outboard motor according to claim 13, wherein the fuel supply line is a fuel rail.

17. The outboard motor according to claim 16, wherein the fuel rail extends vertically.

18. The outboard motor according to claim 13, wherein the first electrical wire is an ignition wire and the two electrical components are a spark plug and an ignition coil.

19. An outboard motor comprising a powerhead including a fuel-injected internal combustion engine and a cowling covering the engine, the engine having an engine body and an output shaft, the engine being mounted in the powerhead so that the output shaft rotates about a generally vertically extending axis, the engine including at least a first fuel injector extending from the engine body generally transverse to the vertical axis, and at least a first cover independent of the cowling, the cover extending over at least a portion of the first fuel injector.

20. The outboard motor according to claim 19, wherein the cover is connected to the engine body.

21. The outboard motor according to claim 20 additionally comprising a fuel rail supplying fuel to the first fuel injector, the cover being connected to the fuel rail.

22. The outboard motor according to claim 21 additionally comprising at least a first projection configured to maintain a gap between an inner side of the first cover and the fuel rail.

23. The outboard motor according to claim 19, wherein the first cover extends along at least one side of the first fuel injector.

24. The outboard motor according to claim 19, wherein the engine body comprises a left-side cylinder bank and a right-side cylinder bank, each having at least two cylinders, first and second left-side fuel injectors communicating with the left-side cylinder bank, first and second right-side fuel injectors communicating with the rightside cylinder bank, and a second cover, the first cover covering the left-side fuel injectors, the second cover covering the right-side fuel injectors.

25. The outboard motor according to claim 24, wherein the first cover extends along a left side of the fuel injectors left-side fuel injectors, the second cover extending along a right side of the right-side fuel injectors.

26. The outboard motor according to claim 19, wherein the engine body comprises a first cylinder bank and a second cylinder bank defining a valley therebetween, each having at least two cylinders and two fuel injectors, each of the fuel injectors having an inner side facing toward the valley and an outer side facing away from the valley, the outboard motor further comprising a second cover covering the outer side of the fuel injectors on the second cylinder bank, the first cover covering the outer side of the fuel injectors on the first cylinder bank.

27. The outboard motor according to claim 19 additionally comprising at least a first projection extending from an inner side of the first cover, the projection extending over the first fuel injector.

28. An outboard motor comprising a powerhead including an internal combustion engine and a cowling covering the engine, the engine having an engine body and an output shaft, the engine being mounted in the powerhead so that the output shaft rotates about a generally vertically extending axis, the engine including a plurality of electrical components, an electronic control unit configured to control operation of the engine, a plurality of electrical conduits connecting the electronic control unit with the plurality of electrical components, and a sleeve extending substantially parallel to the vertical axis, at least one of the plurality of electrical conduits extending from a lower end of the electronic control unit, upwardly through the sleeve, over an upper end of the engine body, and to at least one of the electrical components.

29. The outboard motor according to claim 28 wherein the at least one of the electrical components comprises at least one of a starter motor and a fuel pump.

30. An outboard motor comprising a powerhead including an internal combustion engine and a cowling covering the engine, the engine having an engine body and an output shaft, the engine being mounted in the powerhead so that the output shaft rotates about a vertically extending axis, a first casing containing a first plurality of electrical components which are substantially waterproof, the first casing having a watertight seal along at least an upper periphery thereof, a second casing containing a second plurality of electrical components which are not waterproof, the second container having a watertight seal around substantially an entire periphery thereof and an outlet through which a first plurality of electrical conduits extend into the first casing.

31. The outboard motor according to claim 30, wherein the outlet of the second casing is arranged within the first casing.

32. The outboard motor according to claim 30 additionally comprising a grommet forming a substantially water-tight seal with the electrical conduits extending through the outlet of the second casing.

33. The outboard motor according to claim 30 additionally comprising a second outlet formed on a lower portion of the first casing.

34. The outboard motor according to claim 33, wherein a plurality of electrical conduits extend into the first casing through the second outlet.

35. The outboard motor according to claim 34 wherein the plurality of electrical conduits extend downwardly out of the first casing, through the second outlet, and curve upwardly outside of the first casing.

36. The outboard motor according to claim 34 wherein at least one of the plurality of electrical conduits extends to at least one of the second plurality of electrical components in the second casing.

37. The outboard motor according to claim 30 additionally comprising a first removable cover member covering the first casing and a second removable cover member, independent from the first cover member, covering the second casing.

38. The outboard motor according to claim 37, wherein the second cover member forms the substantially water-tight seal around substantially the entire periphery of the second casing.

39. An outboard motor comprising a powerhead including an internal combustion engine and a cowling covering the engine, the engine having an engine body and an output shaft, the engine being mounted in the powerhead so that the output shaft rotates about a generally vertically extending axis, the engine including a plurality of electrical components, at least a first electrical wire extending between two of the electrical components, at least a portion of the first electrical wire extending transversely to the vertical axis and along an outer periphery of the engine body, a cover covering the transversely extending portion of the electrical wire, a first casing containing substantially waterproof electrical components, at least an upper peripheral edge of the first casing having a substantially water-tight seal, a second casing containing non-waterproof electrical components, the second casing having a substantially water-tight seal along substantially an entire peripheral edge of the second casing, a protective sleeve arranged within the powerhead and extending upwardly, and a plurality of electrical conduits extending through the protective sleeve.

* * * * *